US005895307A

United States Patent [19]

Jamison et al.

[11] Patent Number: 5,895,307

[45] Date of Patent: Apr. 20, 1999

[54] COMBINATION TOP SPINNING PLATFORM AND STORAGE CONTAINER

[76] Inventors: Hunter Jamison, 19004 Leadora; Scot Jamison, 412 W. Carter, both of Glendora, Calif. 91740; Terry Jamison, 1164 Morningside Dr., Claremont, Calif. 91711

[21] Appl. No.: 08/862,129

[22] Filed: May 22, 1997

[51] Int. Cl.[6] ..... A63H 1/00

[52] U.S. Cl. ..... 446/256; 446/75

[58] Field of Search ..... 446/75, 256, 257, 446/264

[56] References Cited

U.S. PATENT DOCUMENTS

| | | | |
|---|---|---|---|
| D. 58,079 | 6/1921 | Glenn . | |
| 523,513 | 7/1894 | Coffin . | |
| 2,619,769 | 12/1952 | Gallaher | 446/257 |
| 2,639,921 | 5/1953 | Saunders . | |
| 3,130,973 | 4/1964 | Zapolski | 446/256 X |
| 3,594,943 | 7/1971 | Ryan . | |
| 4,076,252 | 2/1978 | Bernier et al. | 273/141 R |
| 4,200,283 | 4/1980 | Andrews et al. | 273/108 |
| 4,856,790 | 8/1989 | Camillo | 446/256 |
| 4,932,918 | 6/1990 | Onoda | 446/256 |
| 4,954,116 | 9/1990 | Rubino | 446/256 |
| 5,129,655 | 7/1992 | Gillespie et al. | 273/241 |
| 5,484,056 | 1/1996 | Wood | 206/349 |
| 5,593,338 | 1/1997 | Itoh et al. | 446/259 |
| 5,683,083 | 11/1997 | Karabekian et al. | 446/257 |

FOREIGN PATENT DOCUMENTS

| | | | |
|---|---|---|---|
| 538120 | 3/1957 | Canada | 446/256 |
| 2614800 | 11/1988 | France | 446/256 |
| 245108 | 6/1945 | Switzerland . | |
| 9096 | of 1894 | United Kingdom | 446/256 |

*Primary Examiner*—Kien T. Nguyen
*Assistant Examiner*—Laura Fossum
*Attorney, Agent, or Firm*—John R Duncan; Frank D. Gilliam

[57] ABSTRACT

A combination of a top, and a base that has a flat surface upon which the top may be spun and a cavity for storing the top when the top is not in use. The top has a pointed end upon which it is spun, an opposite handle end and an intermediate disk-like mass. The surface has an upstanding peripheral ridge to keep the spinning top on the surface. The cavity is sized to receive the top pointed end first. An O-ring is held in a groove in the cavity surface and extends into the cavity. When the top is pushed into the cavity, the disk engages the O-ring and is resiliently held in place. The top is removed for use by reaching fingers into the cavity opening, grasping the handle and withdrawing the top. A base having a number of these cavities may also be provided for storing a number of the tops.

3 Claims, 2 Drawing Sheets

COMBINATION TOP SPINNING PLATFORM AND STORAGE CONTAINER

FIELD OF THE INVENTION

This invention relates to a novelty item including a top that can be manually spun.

BACKGROUND OF THE INVENTION

A great number of tops of one form or another have been developed over the years as a child's toy and as adult novelties. A basic top includes a mass, often disk-shaped, to provide the inertial forces to keep a top spinning, a point on one side of the mass for engaging a horizontal surface during spinning and a peg or the like on the opposite side of the mass for grasping by the fingers to spin the top.

Many different top configurations and spinning methods have been developed. A string may be wound around the top and pulled to set the top spinning. Some large tops are spun by a pumping mechanism including a vertically movable twisted metal band. Others may include lights, noise makers, etc. Spinning a top can be both enjoyable and relaxing. Typical such tops are described in U.S. Pat. Nos. 2,639,921 to Saunders, DES58,079 to Glenn, 3,594,943 to Ryan et al. and 4,076,252 to Bernier et al.

A spinning top will tend to move off an edge of an other than horizontal surface. This will reduce spinning time and enjoyment of the top. Therefore, in order to obtain the maximum spin time it is often necessary to carefully level the surface and/or provide a very large unobstructed surface. This is often not possible on a crowded desk or table top, reducing the free spinning period.

When a top is not in use, it will tend to slide and roll on a desk or table surface. Desirably, the top will be stored in a suitable container when not in use. Such containers should be attractive and fully house the top. A base having a surface upon which a top may be spun and to which the top may be clipped when not in use is described by Tecto in Swiss Patent No. 245,108. While utilitarian, this arrangement leaves the top exposed where it could be easily dislodged from the base.

Other containers for tops are disclosed by Coffin in U.S. Pat. No. 523,513. Again, the top is simply fastened to a base, which does not have an attractive appearance when kept on a desk or the like.

Thus, there is a continuing need for improved novelty top assemblies that have an attractive top that can be easily spun and will spin for a relatively long period, that provide a spinning surface that will allow the top to move easily across the surface but will prevent the top from leaving the surface, that will securely house the top when not in use and will provide a sleek, attractive appearance when the top is housed.

SUMMARY OF THE INVENTION

The above-noted problems, and others, are overcome by a novelty top and base assembly that basically comprises a top having an elongated central shaft portion having a generally pointed first end and a generally cylindrical second end and a disk shaped central mass coaxial with the shaft portion to provide the gyroscopic effect keeping the top upright while spinning. A base comprises a first generally flat surface having an upstanding ring around the flat surface and a second surface opposite the first surface, with a substantially cylindrical cavity in the second surface for receiving the top therein. The cavity includes elastic means for allowing the top to be pushed into the cavity and for releasably retaining the top therein.

Preferably, the cavity has a bottom configured to receive the top pointed first end, sidewalls configured to closely receive the disk shaped central mass, with the second shaft end fully received into the cavity. The elastic means preferably includes circumferential groove in said cavity, located at approximately the position of the top central disk when the top is fully inserted into the cavity. An elastic ring, similar to a conventional rubber O-ring, is fitted into the cavity and projects lightly into the cavity. When the top is pressed into the cavity, the elastic ring will engage the top central disk and will hold the top in place. The base can be handled, moved, turned upside down, etc. without releasing the top. However, the handle end of the central shaft can easily be grasped with the fingers and the top removed from the cavity.

In use, the base is placed on any surface with the upper base surface approximately horizontal. The handle end is grasped between two fingers and the top is spun and release over the base upper surface. The top will spin about the surface, with the raised edge preventing the top from falling off the surface.

In an alternative housing embodiment, a block may have a plurality of apertures, each as described above, for receiving a corresponding number of tops. Each aperture preferably includes a groove and O-ring as described, for holding a top in place even if the block is inverted. The tops may have different indicia, e.g., different colors, so that they can be distinguished when several tops are spun together in a competition, such as to see who can spin a top for the greatest spin duration.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
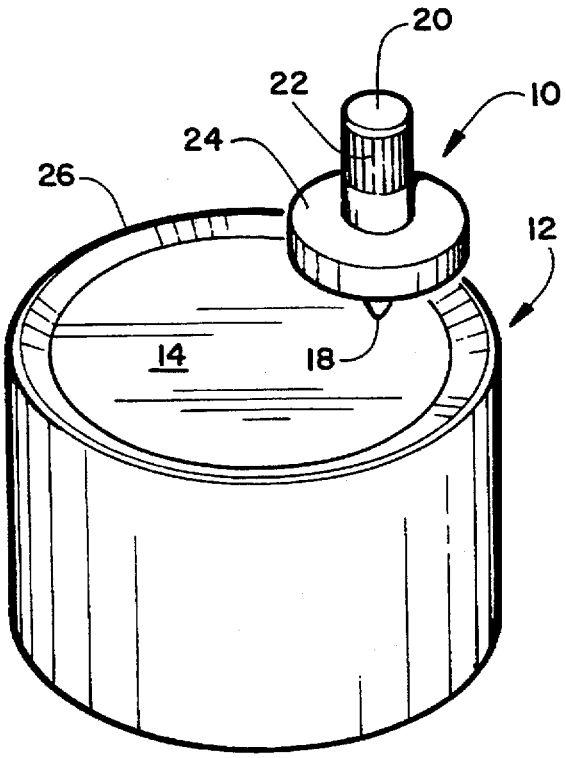
FIG. 1 is a perspective view of the top spinning on the base.

As seen in the Figures, the combination top, top spinning platform and top storage kit basically includes a top 10 and a base 12 which has a spinning surface 14 and a storage cavity 16.

Top 10 has a central shaft portion having a pointed proximal end 18 and a distal handle end 20. Handle end 20 is gripped between the fingers and twisted to start the top spinning. Preferably, handle end 20 is roughened, such as by shallow longitudinal grooves 22 to aid the spinning grip. A central disk-like mass 24 is formed along the central shaft portion intermediate ends 20 and 22.

Top 10 may be formed from any suitable material, such as metal, plastic, ceramic or the like. Preferably, top 10 is formed from aluminum, which can be anodized to provide bright, attractive colors. Top 10 may be formed from a single piece of material by molding, machining, etc. or may be formed by inserting a cylindrical shaft portion through a hole in disk 24 and bonding the components together.

Base 12 has a generally flat spinning surface 14 with an upstanding peripheral ridge 26. While ridge 26 could have any suitable configuration, a surface sloping upwardly and outwardly from surface 14 at an angle to surface slightly less than the angle of the side of pointed end 18 to the horizontal when the top is spinning is preferred. Typically, the angle of the inner side of ridge 26 to surface 14 may be from about 20 to 40° and the slope of the side of pointed end 18 to surface 14 when spinning may be about 50 to 70°. This slope relationship has been found to provide the optimum guidance to the top when it engages ridge 26 during spinning to maintain the maximum spinning time period.

Figure 2:
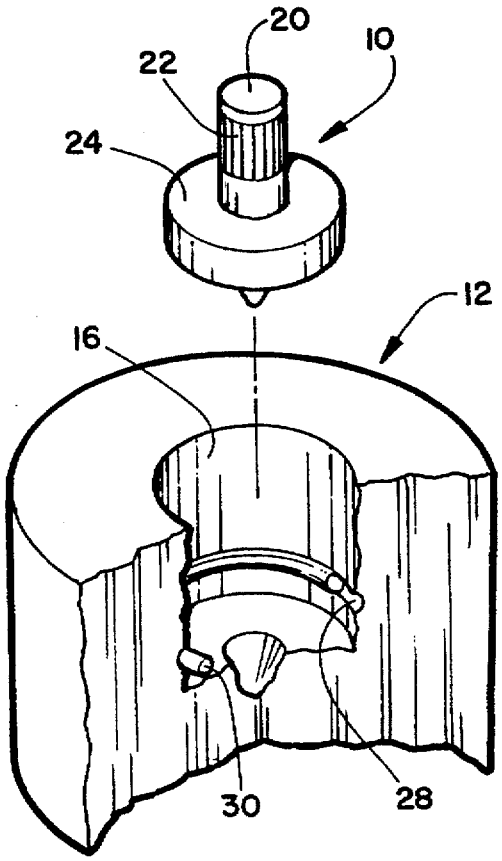
FIG. 2 is an exploded perspective view, partially cutaway, of the inverted base as the top is inserted into the base cavity for storage.
Figure 3:
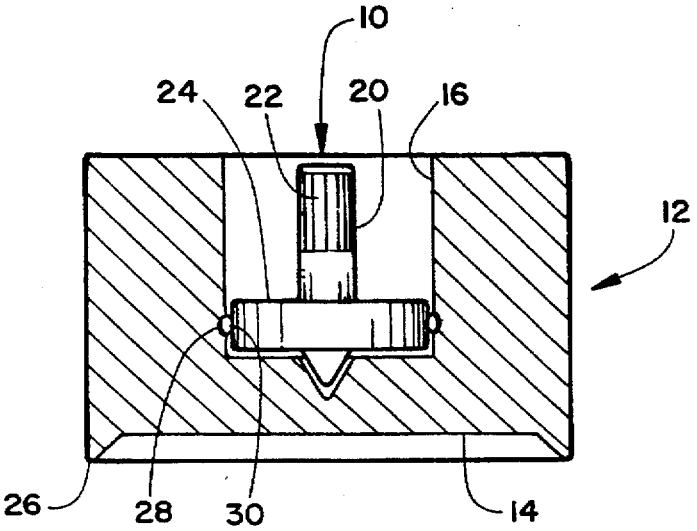
FIG. 3 is an axial section view through the top and base in the top stored position.

As best seen in FIGS. 2 and 3, the surface of base 12 opposite surface 14 has a cylindrical cavity 16 having a diameter just slightly greater than the diameter of disk 24, to provide a sliding fit of the top in the cavity. The bottom of cavity 16 is configured to match the underside of disk 24 and pointed proximal end 18. While base 12 may be formed from any suitable material, such as metal, plastic or the like, machined aluminum that is anodized to provide a bright, attractive color is preferred.

A groove 28 is formed around the inner surface of cavity 16 in a plane generally perpendicular to the axis of the cavity. A ring 30 of elastic material, typically a conventional rubber O-ring, is held in grove 28 with about half of the O-ring diameter extending above the surface of the wall of cavity 16. As top 10 is fully inserted into cavity 16, disk portion 24 will engage O-ring 30 and be held in place by the O-ring resiliency. The top can be easily removed from storage in cavity 16 by grasping distal handle end 20 with the fingers and pulling the top from the cavity.

Thus, when the kit is in use as a desk top novelty or "executive toy", the unit may be used as a brightly colored, anodized aluminum paperweight. When stress reaches a level requiring relief, top 10 can be pulled from cavity 16 and spun on surface 14. Watching the top spin can provide a relaxing interlude in a busy, stress filled day.

Figure 4:
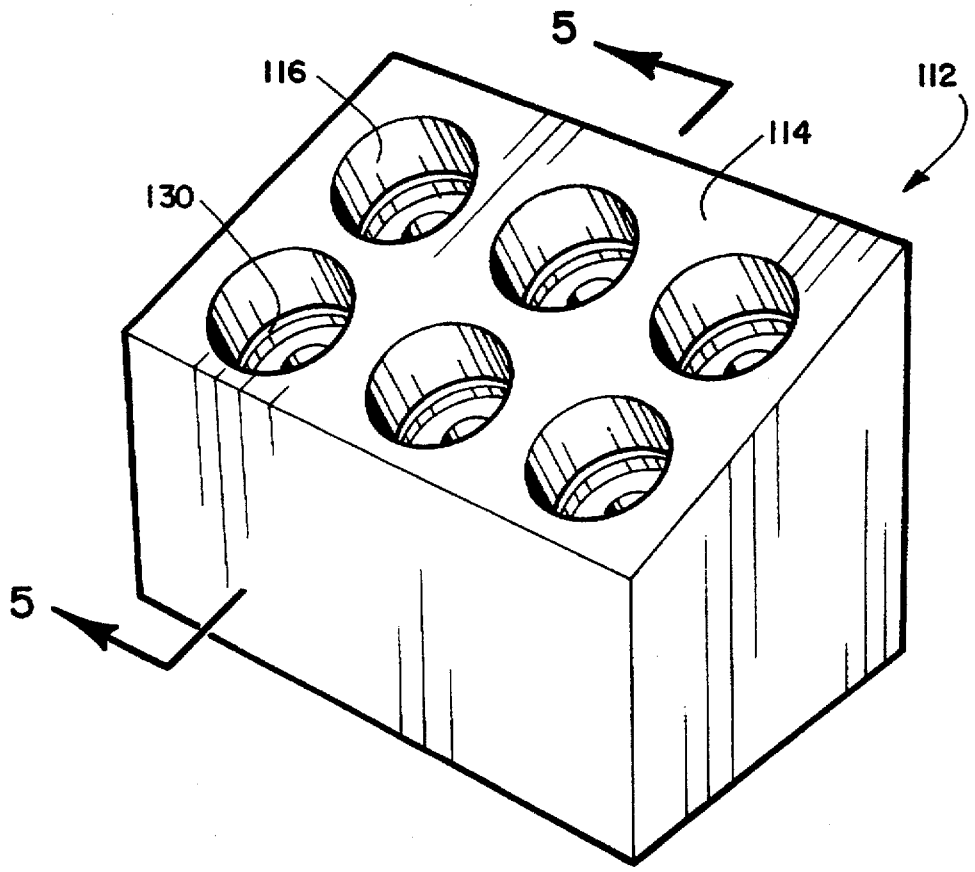
FIG. 4 is a perspective view of a housing for holding a plurality of tops.
Figure 5:
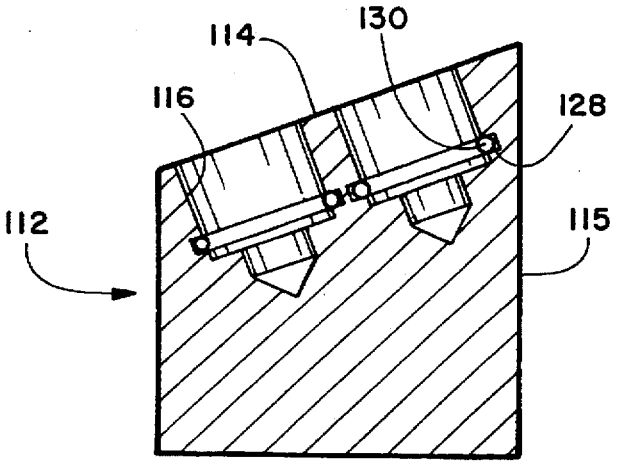
FIG. 5 is a section view taken on line 5—5 in FIG. 4, showing the interior configuration of the top storage cavities.

An alternate top storage base arrangement is shown in FIGS. 4 and 5, in which a plurality of tops may be stored. A base 112, typically a solid block of aluminum or other desired material, has a plurality of cavities 116 across a surface 114. While base 112 could be rectangular or any other desired shape, preferably top surface 114 is angled relative to the block vertical walls for ease of seeing tops in the cavities. Various indicia, such as advertising or the like, can be applied to front surface 115.

Each cavity 116 includes a groove 128 in which an O-ring 130 is seated. A top 10 of the sort seen in FIGS. 1 and 2 can be seated in each cavity and held in place by an O-ring 130 if base 112 is inverted, tipped over, etc.

Each top may have distinguishing indicia, such as a number or letter at the end of handle 20, a colored handle end or could have a different over all color. Where tops 10 are formed from aluminum, anodizing the different tops in different colors would provide bright, attractive, distinguishing colors.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

We claim:

1. A combination top, top spinning platform and top, storage kit which comprises:

a top having a central mass with opposite parallel first and second faces and a generally cylindrical rim;

a generally cylindrical handle shaft extending centrally from said first face with said handle permanently fixed to said central mass;

a shaft having a generally conical proximal end extending centrally from said second face with said shaft permanently fixed to said central mass;

a body having a first substantially flat planar surface adapted to support said top while spinning;

an upstanding inverted frusto conical rim around said first substantially flat surface, said rim having an inner intersecting said substantially flat surface for preventing said top from spinning off of said substantially flat surface;

an inner side of said rim having an angle to said first substantially flat planar surface less than an angle between said conical proximal end and said first substantially flat surface when said top is spinning on said first substantially flat surface;

an open cavity in a second surface of said body for receiving said top therein for storage;

said cavity having a generally cylindrical wall sized to permit said central mass to slide in and out of said cavity;

said cavity having a generally substantially flat end wall for engaging said first substantially flat surface when said top is fully inserted into said cavity and a central cavity for receiving said conical proximal end when said top is fully inserted into said cavity;

a circumferential groove is said cylindrical wall portion; and an elastic O-ring in said groove and extending into said cavity for engaging said generally cylindrical rim when said top is placed in said open cavity and for releasably retaining said top therein when said top is positioned with said open cavity downward.

2. The kit according to claim 1 further including a plurality of axial grooves in said handle shaft.

3. The kit according to claim 1 wherein said angle between the inner side of said rim and said first substantially flat planar surface is about 20–40 degrees and said angle between said conical proximal end and said first substantially flat planar surface when said top is spinning is about 50–70 degrees.

* * * * *